US009194062B2

(12) United States Patent
Wang

(10) Patent No.: US 9,194,062 B2
(45) Date of Patent: Nov. 24, 2015

(54) CARBON FIBER SURFACE OIL CHANGING METHOD

(71) Applicant: UHT UNITECH CO., LTD., Zhongli, Taoyuan County (TW)

(72) Inventor: Chih-Yung Wang, Taoyuan (TW)

(73) Assignee: UHT UNITECH CO., LTD., Zhongli, Taoyuan County (TW)

( * ) Notice: Subject to any disclaimer, the term of this patent is extended or adjusted under 35 U.S.C. 154(b) by 265 days.

(21) Appl. No.: 13/963,334

(22) Filed: Aug. 9, 2013

(65) Prior Publication Data

US 2015/0044373 A1 Feb. 12, 2015

(51) Int. Cl.
*B05D 3/10* (2006.01)
*D01G 9/00* (2006.01)

(52) U.S. Cl.
CPC ..... *D01G 9/00* (2013.01)

(58) Field of Classification Search
CPC ..... C04B 35/83
See application file for complete search history.

(56) References Cited

U.S. PATENT DOCUMENTS

| | | | | |
|---|---|---|---|---|
| 5,776,383 | A * | 7/1998 | Darrieux et al. | 264/29.1 |
| 2006/0070403 | A1* | 4/2006 | Tessier et al. | 65/17.2 |
| 2013/0089736 | A1* | 4/2013 | Nakayama et al. | 428/375 |

* cited by examiner

*Primary Examiner* — Nathan T Leong
(74) *Attorney, Agent, or Firm* — Jackson IPG PLLC; Demian K. Jackson

(57) ABSTRACT

A changing method includes the steps of supplying a carbon fiber material with a surface covered by a thermosetting resin oil, performing a desizing step to remove the thermosetting resin oil from the surface of the carbon fiber material, performing a surfactant coating step to coat a surfactant onto the surface of the carbon fiber material, and performing a sizing step to cover a surface of the surfactant by a thermosetting resin oil, so as to obtain a carbon fiber material with a thermosetting resin oil coated onto the surface of the carbon fiber material.

18 Claims, 5 Drawing Sheets

CARBON FIBER SURFACE OIL CHANGING METHOD

FIELD OF THE INVENTION

The present invention relates to a changing method, in particular to a carbon fiber surface oil changing method.

BACKGROUND OF THE INVENTION

In general, carbon fiber is used in composite enhanced substances with different types of substrates, and the adhesiveness of a specific substrate is important to carbon the fiber to show the characteristics of the enhanced substances.

Non-surface treatment carbon fibers usually have insufficient adhesiveness for the substrate and poor transverse properties such as the separating strength and shear strength. Naturally, the carbon fiber generally receives an oxidization treatment such as an electrolytic oxidation treatment, a gas-phase chemical oxidation treatment or a liquid-phase chemical oxidation treatment after a carbonization or graphitization takes place, and oxygen-containing functional groups are added into the carbon fiber to improve the wettability of the substrates.

With regard to the surface characteristics of the carbon fiber after being processed by the oxidization treatment, Japan Patent Publication 4-361619 disclosed a method of improving the adhesive strength of the carbon fiber to the substrate by depositing a specific functional group onto the uppermost surface of the carbon fiber. This patent also specifies the carbon fiber whose surface oxygen concentration and surface nitrogen concentration are both measured by X-ray optoelectronic spectroscopy measurement techniques (such as those disclosed in Japan Examined Patent Publication No. 4-44016, and Japan Unexamined Patent Application Publication Nos. 2-210059, 2-169763, 63-85167, and 62-276075), but these inventions do not include the study of a combination of a sizing agent. In addition, these patents are simply described by using the surface functional groups such as the drawback of having a poor adhesion with a substrate, particularly the substrate with a low reactivity.

On the other hand, carbon fiber and graphite fiber are peculiarly hard and brittle and lack of adhesiveness, bending strength and wear-resistance, so that various different types of sizing agents are generally added into the treated carbon fiber to prevent the formation of fine hair and the occurrence of thread fracture, so as to improve the adhesiveness, bending strength and wear-resistance. Studies on developing and using a sizing agent such as a paste or an adhesive to improve the treatment are conducted, but the study on the improvement of adhesiveness of the sizing agent to a substrate has not been actually performed. In addition, the study on modifying surface characteristics by a sizing agent has not been performed. For example, the functional groups on the aforementioned carbon fiber surface are used to improve the overall characteristics including adhesiveness and tension of a composite.

Since the most popular substrate used in a carbon fiber enhancing composite substance is epoxy resin, and the sizing agent is usually epoxy resin or modified epoxy resin which are biphenol A diglycidyl ether type epoxy resins such as aromatic compounds with a structure related to the substrate (as disclosed in Japan Examined Patent Publication No. 4-8542, Japan Unexamined Patent Application Publication No. 1-272867, and Japan Examined Patent Publication Nos. 62-56266 and 57-15229). However, the aforementioned common sizing agent is a thermosetting resin, so that if it is necessary to produce a thermoplastic carbon fiber composite material, then the interface will not be matched, and the carbon fiber and the resin will be unable to form a complete joint interface, and the sizing agent cannot be used extensively for electric/electronic components, mechanical components or automobile components which are manufactured by injection molding. Therefore, it is an urgent and important subject for related manufacturers to develop a changing method capable of changing the carbon fiber surface oil.

SUMMARY OF THE INVENTION

In view of the aforementioned problems of the conventional oil changing method, it is a primary objective of the present invention to provide a changing method capable of changing a carbon fiber surface oil in order to overcome the drawbacks of the prior art.

To achieve the aforementioned objective, the present invention provides a changing method comprising the steps of supplying a carbon fiber material with a surface covered by a thermosetting resin oil, performing a desizing step to remove the thermosetting resin oil from the surface of the carbon fiber material, performing a surfactant coating step to coat a surfactant onto the surface of the carbon fiber material, and performing a sizing step to cover a surface of the surfactant by a thermosetting resin oil, so as to obtain a carbon fiber material with a thermosetting resin oil coated onto the surface of the carbon fiber material.

DESCRIPTION OF THE PREFERRED EMBODIMENTS

The present invention will become clearer in light of the following detailed description of an illustrative embodiment of this invention described in connection with the drawings. It is intended that the embodiments and drawings disclosed herein are to be considered illustrative rather than restrictive.

Figure 1:
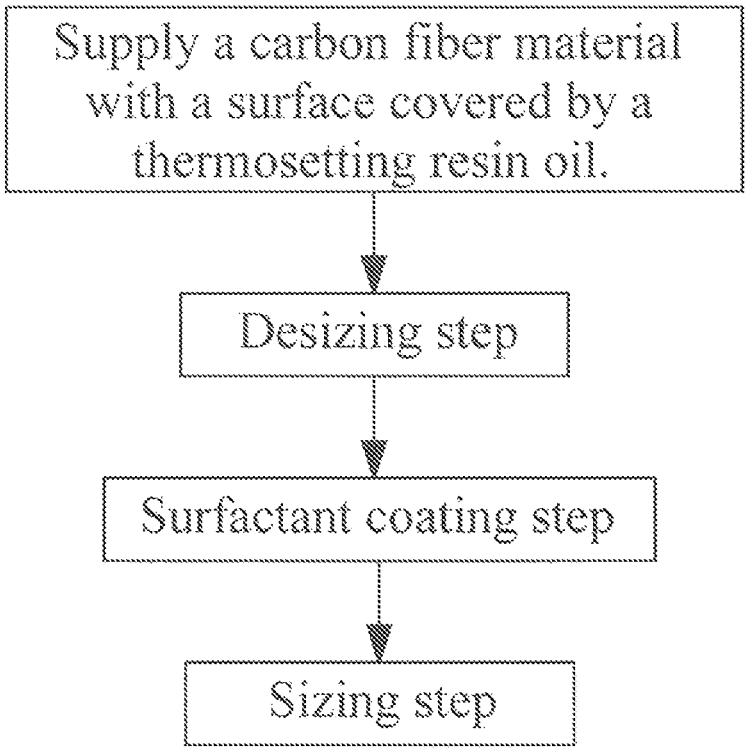
FIG. 1 is a flow chart of a changing method of the present invention.
Figure 2:
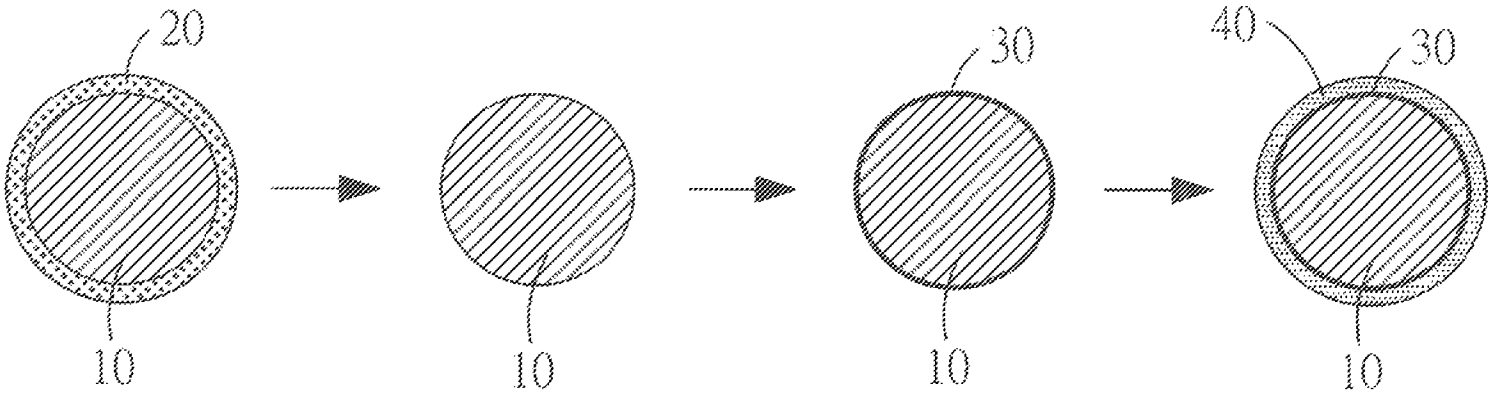
FIG. 2 is a schematic view of changing a carbon fiber surface of the present invention.

With reference to FIG. 1 for a flow chart of a changing method of the present invention, the changing method 1 comprises the following steps:

Provide a carbon fiber material as shown in FIG. 2, wherein a thermosetting resin oil 20 is covered onto a surface of the carbon fiber material 10, and the carbon fiber can be of any type or a different K number, and the types of the carbon fiber include polyacrylonitrile (PAN), pitch, rayon or phenolic fiber, and the K number (thousands of filaments per tow) of the carbon fiber can be 1K, 3K, 6K, 12K, 24K, 48K, 50K or 60K.

Perform a desizing step to remove the thermosetting resin oil from the surface of the carbon fiber material to form a carbon fiber material 10 without any oil on the surface (as shown at the position on the left of the center of FIG. 2), wherein the desizing step is conducted at a high temperature of 250~650° C. for 1~60 seconds, or an organic solvent (such as acetone or chloroform) is used to clean the surface of the carbon fiber material in order to remove the thermosetting resin oil from the surface of the carbon fiber material 10.

Perform a surfactant coating step, wherein the surfactant 30 is covered onto the surface of the carbon fiber material 10. In this step, ethanol is used for cleaning the surface of the carbon fiber material first, and then 0.5~1 wt % of amine-containing surfactant and 99~99.5 wt % of aqueous ethanol are used for coating the surface, and this method can be an aerosol spray method or a dipping method, such that the surfactant 30 is covered onto the surface of the carbon fiber material 10, and the surfactant 30 facilitates applying the oil onto the surface again and forming a complete interface with the carbon fiber surface.

Perform a sizing step, wherein a thermoplastic resin oil 40 is covered onto a surface of the surfactant 30. In this step, a soaking method or an immersion method can be used for attaching the thermoplastic resin oil 40 onto the surface of the surfactant 30, and the thermoplastic resin oil can be PU, PE, PP, acrylic or PC/ABS oil with a concentration of 0.1~5 wt % for sizing.

Figure 3:
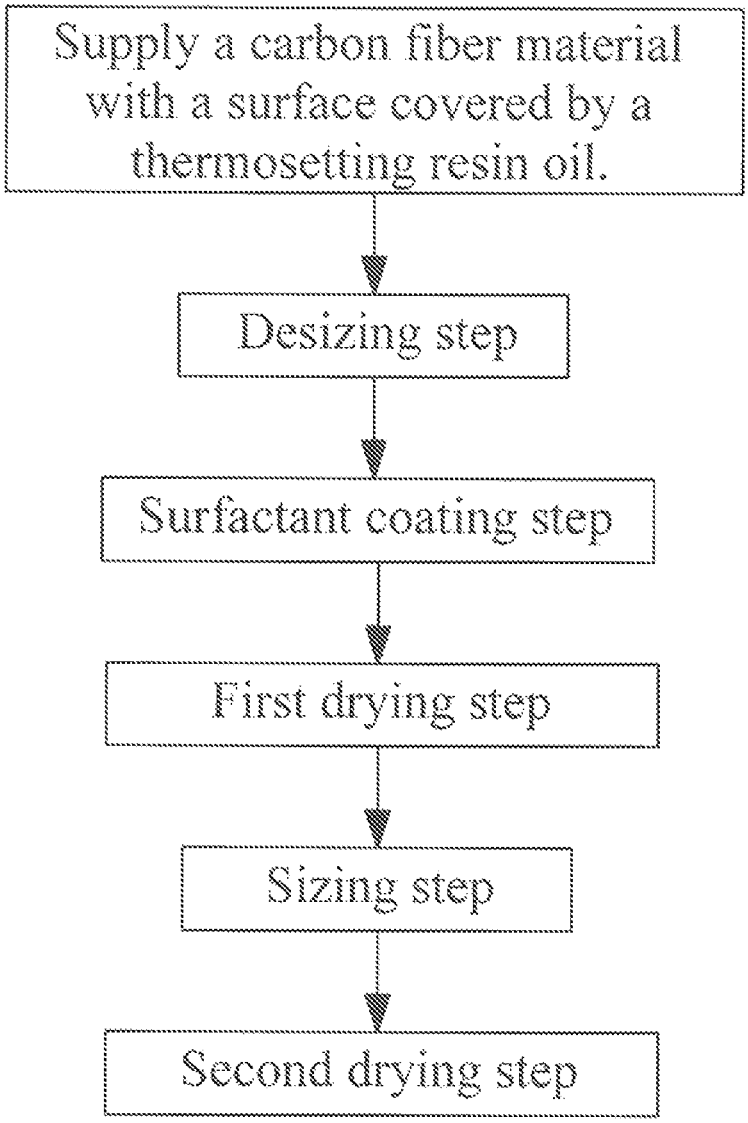
FIG. 3 is another flow chart of a changing method of the present invention.

Of course, a first drying process can be added between the surfactant coating step and the sizing step, and a second drying process can be added after the sizing step takes place as shown in FIG. 3. In the first drying step, a hot air drying method can be used for drying at a temperature of 20~50° C. by air. Until the surfactant on the surface of the carbon fiber is shaped, the sizing step is performed. In the second drying process, a drying oven is used for drying, wherein the drying temperature is 120~300° C.

It is noteworthy that the present invention can change a carbon fiber surface oil, particularly can change the original thermosetting resin oil on the surface of the carbon fiber into a thermoplastic resin oil, so that when the carbon fiber is used for manufacturing a thermoplastic carbon fiber composite material, the carbon fiber and the resin can form a complete joint interface, and the carbon fiber can be applied extensively in various different types of electric/electronic components, mechanical components and automobile components manufactured by injection molding.

For example, Model No. T700, PAN type carbon fibers with a K number of 12K/24K (manufactured by Japanese Toray Company) can be used in the method of the present invention, and the thermoplastic resin oil (PP, PU, acrylic, or PC/ABS oil can be changed according to the changing step of the present invention; or Model No. TC36, PAN type carbon fibers with a K number of 12K/24K (manufactured by Taiwanese Formosa Company) can be used in the method of the present invention, and the thermoplastic resin oil (PP, PU, acrylic, or PC/ABS oil can be changed according to the changing step of the present invention; or Model No. K63712, pitch type carbon fibers with a K number of 12K/24K (manufactured by Japanese Mitsubishi Company) can be used in the method of the present invention, and the thermoplastic resin oil (PP, PU, acrylic, or PC/ABS oil can be changed according to the changing step of the present invention.

Figure 4:
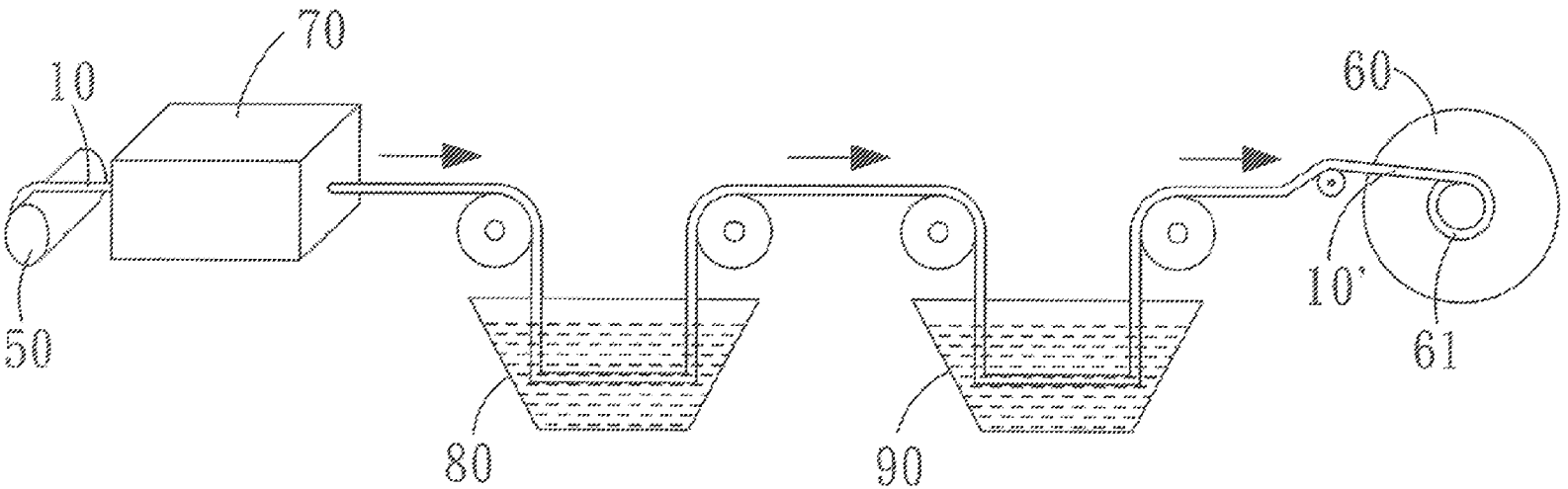
FIG. 4 is a schematic view of a changing device of the present invention.

In addition, the present invention further uses a changing device to carry out the aforementioned steps. With reference to FIG. 4 for a schematic view of a changing device of the present invention, the changing device comprises a feed component 50, a winder 60, a desizing oven 70, a coating component 80 and a sizing component 90.

The feed component 50 is used for supplying a carbon fiber material 10, and a thermosetting resin oil 11 is covered onto a surface of the carbon fiber material 10, wherein the carbon fiber can be of any type or a different K number (standing for thousand of filaments per tow).

The winder 60 is installed behind the feed component 50 and includes at least one rewinding part 61, wherein an end of the carbon fiber material 10 is wound to the feed component 50, and the other end of the carbon fiber material 10 is manufactured to form a carbon fiber product 10' to be wound to the rewinding part 61.

The desizing oven 70 is installed between the feed component 50 and the winder 60 for removing the thermosetting resin oil from the surface of the carbon fiber material to produce a carbon fiber material 10 without any oil on the surface as shown at the position on the left of the center of FIG. 2, and the desizing oven 70 includes a heating component capable of heating up to a high temperature of 250~650° C. for 1~60 seconds for desizing, or the desizing oven includes a first reservoir provided to store an organic solvent (such as acetone or chloroform) for cleaning the surface of the carbon fiber material in order to remove the thermosetting resin oil from the surface of the carbon fiber material.

The coating component 80 is connected behind the desizing oven 70, and a surfactant 12 is covered onto the surface of the carbon fiber material 10, wherein the coating component sequentially includes second and third reservoirs (not shown in the figure), and the second reservoir is provided to store ethanol for cleaning the surface of the carbon fiber material, and the third reservoir is provided to store 0.5~1 wt % of amine-containing surfactant and 99~99.5 wt % of aqueous ethanol, and an aerosol spray method or a soaking method is adopted to coat the surfactant 12 onto the surface of the carbon fiber material 10, and the surfactant 12 facilitates applying the oil onto the surface of the carbon fiber material 10 again and forming a complete interface with the carbon fiber surface.

The sizing component 90 is connected behind the coating component 80, and a thermoplastic resin oil 13 is covered onto a surface of the surfactant 12 to form a carbon fiber product 10' to be wound onto a rewinding part 61 of the winder 60, wherein the sizing component 90 includes a fourth reservoir provided to store a thermoplastic resin oil which can be PU, PE, PP or acrylic oil and attached onto a surface of the surfactant 12 by a soaking method or an immersion method.

Figure 5:
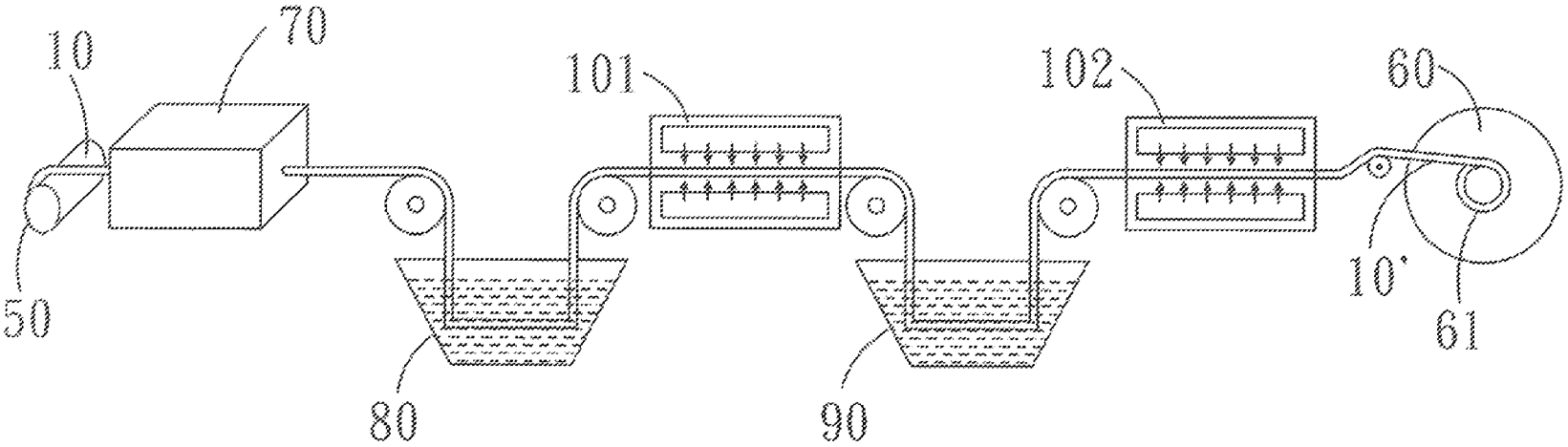
FIG. 5 is another schematic view of a changing method of the present invention.

In FIG. 5, a first drying component 101 is further installed between the coating component 80 and the sizing component 90, wherein the first drying component 101 is a hot air drying oven, and a second drying component 102 is further installed behind the sizing component 90 for achieving the drying and shaping effects.

In summation of the description above, the present invention improves over the prior art, and is thus duly filed for patent application. While the invention has been described by means of specific embodiments, numerous modifications and variations could be made thereto by those skilled in the art without departing from the scope and spirit of the invention set forth in the claims.

What is claimed is:

1. A carbon fiber surface oil changing method, comprising the steps of:

supplying a carbon fiber material with a surface covered by a thermosetting resin oil;

performing a desizing step to remove the thermosetting resin oil from the surface of the carbon fiber material;

performing a surfactant coating step to cover the surface of the carbon fiber material with a surfactant; and performing a sizing step to cover a surface of the surfactant with the thermosetting resin oil, wherein the surfactant coating steps uses ethanol to clean to surface of the carbon fiber material, and then uses 0.5~1 wt % of amine-containing surfactant and 99~99.5 wt % of aqueous ethanol to perform the coating.

2. The carbon fiber surface oil changing method of claim 1, wherein the desizing step is conducted at a high temperature of 250~650° C. for 1~60 seconds.

3. The carbon fiber surface oil changing method of claim 1, wherein the desizing step adopts an organic solvent to clean the surface of the carbon fiber material.

4. The carbon fiber surface oil changing method of claim 3, wherein the organic solvent is acetone or chloroform.

5. The carbon fiber surface oil changing method of claim 1, wherein the surfactant coating step adopts an aerosol spray method or a soaking method.

6. The carbon fiber surface oil changing method of claim 1, further comprising a first drying step taken place between the surfactant coating step and the sizing step.

7. The carbon fiber surface oil changing method of claim 1, wherein the sizing step adopts a soaking method or an immersion method.

8. The carbon fiber surface oil changing method of claim 1, wherein the thermosetting resin oil is one selected from the group of PU, PE, PP, acrylic and PC/AB oils.

9. The carbon fiber surface oil changing method of claim 1, wherein the sizing step further comprises a second drying step.

10. A carbon fiber surface oil changing method, comprising the steps of:

supplying a carbon fiber material with a surface covered by a thermosetting resin oil;

performing a desizing step to remove the thermosetting resin oil from the surface of the carbon fiber material;

performing a surfactant coating step to cover the surface of the carbon fiber material with a surfactant; and performing a sizing step to cover a surface of the surfactant with the thermoplastic resin oil, wherein the surfactant coating steps uses ethanol to clean to surface of the carbon fiber material, and then uses 0.5~1 wt % of amine-containing surfactant and 99~99.5 wt % of aqueous ethanol to perform the coating.

11. The carbon fiber surface oil changing method of claim 10, wherein the desizing step is conducted at a high temperature of 250~650° C. for 1~60 seconds.

12. The carbon fiber surface oil changing method of claim 10, wherein the desizing step adopts an organic solvent to clean the surface of the carbon fiber material.

13. The carbon fiber surface oil changing method of claim 12, wherein the organic solvent is acetone or chloroform.

14. The carbon fiber surface oil changing method of claim 10, wherein the surfactant coating step adopts an aerosol spray method or a soaking method.

15. The carbon fiber surface oil changing method of claim 10, further comprising a first drying step taken place between the surfactant coating step and the sizing step.

16. The carbon fiber surface oil changing method of claim 10, wherein the sizing step adopts a soaking method or an immersion method.

17. The carbon fiber surface oil changing method of claim 10, wherein the thermoplastic resin oil is one selected from the group of PU, PE, PP, acrylic and PC/AB oils.

18. The carbon fiber surface oil changing method of claim 10, wherein the sizing step further comprises a second drying step.

* * * * *